US006929669B2

(12) United States Patent
Tominaga et al.

(10) Patent No.: US 6,929,669 B2
(45) Date of Patent: Aug. 16, 2005

(54) ABRASIVE SOLID

(75) Inventors: Nakao Tominaga, Sakurai (JP); Yoshikazu Kondo, Nara (JP); Ryuzo Yamamoto, Sakai (JP)

(73) Assignee: Sakura Color Products Corporation, Osaka (JP)

( * ) Notice: Subject to any disclaimer, the term of this patent is extended or adjusted under 35 U.S.C. 154(b) by 0 days.

(21) Appl. No.: 10/647,599

(22) Filed: Aug. 25, 2003

(65) Prior Publication Data

US 2004/0035058 A1 Feb. 26, 2004

Related U.S. Application Data

(63) Continuation-in-part of application No. 10/073,622, filed on Feb. 11, 2002, now abandoned.

(30) Foreign Application Priority Data

Sep. 2, 2002 (JP) ..... 2002-257093

(51) Int. Cl.[7] ..... B24D 3/00
(52) U.S. Cl. ..... 51/298; 51/307; 51/308; 51/309
(58) Field of Search ..... 51/298, 307, 308, 51/309

(56) References Cited

U.S. PATENT DOCUMENTS 3,867,795 A * 2/1975 Howard ..... 451/548
3,982,358 A * 9/1976 Fukuda ..... 451/544
3,982,359 A * 9/1976 Elbel et al. ..... 51/295
4,142,870 A * 3/1979 Lovejoy ..... 51/298
4,910,924 A * 3/1990 Holden et al. ..... 451/548
5,129,919 A * 7/1992 Kalinowski et al. ..... 51/309
5,218,949 A * 6/1993 Tomlinson et al. ..... 125/21
5,273,559 A * 12/1993 Hammar et al. ..... 51/298
5,314,512 A * 5/1994 Sexton ..... 51/293
5,679,067 A * 10/1997 Johnson et al. ..... 451/527
5,912,216 A * 6/1999 Thimmappaiah et al. ..... 51/298

* cited by examiner

*Primary Examiner*—Michael A Marcheschi
(74) *Attorney, Agent, or Firm*—Wood, Phillips, Katz, Clark & Mortimer

(57) ABSTRACT

An abrasive solid is composed of an organic high polymer matrix and an abrasive material dispersed in the matrix to form a solid mass, whose cutting resistance is from 2 kgf (19.6 N) to 15 kgf (147 N) so that the abrasive solid is severable into two with use of a knife, cutter or the like tool and highly effective to remove rust from any target article. Two or more of such abrasive solids each having these properties are consolidated to form an integral piece that can be trimmed into any desired shape so as to perform both the rough and smooth abrasion works for removal of rust, without using and changing any ordinary abrasive tools one after another.

17 Claims, 11 Drawing Sheets

ABRASIVE SOLID

This application is a continuation-in-part of Ser. No 10/073,622, filed Feb. 11, 2002, entitled "Abrasive Solid", now abandoned.

BACKGROUND OF THE INVENTION

1. Field of the Invention

The present invention relates to an abrasive solid. This solid mass is adapted for use to remove the rust and/or stains from the surfaces of automobile vehicles, household electric apparatuses or the like.

2. Description of Related Art

Generally, metal products such as automobile vehicles and electric apparatuses are likely to become rusted during a long term of usage. Their painted surfaces had often been injured to expose naked metallic areas large or small, causing rust thereon. Usually, smooth files, 'rougher files' (viz., rasps) or abrasive papers have been used to remove such rust.

A highly skilled work using files or abrasive papers is however needed to derust any narrow or complicated areas. In case of using a smooth file, it is difficult to put its corner region neatly in such a narrow rusted area.

If an abrasive paper is used, a properly shaped wooden accessory piece like a guiding batten or template must be placed along the narrow rusted area. In this case, the effect of such a derusting operation depends upon preciseness in shape of the template. Any template or batten can not necessarily match all the possible configurations of articles that are to be derusted. Wherever abrasive papers are used it will require much labor to prepare many templates of various shapes in conformity with narrow areas or complicated surfaces.

Rasps, effective to removal of rust from cars or the like, will however scratch the surfaces thereof. Files must be used for mending such injured surfaces, so that every worker must have in hand some files and some rasps so as to select and use them one after another in an intricate manner.

Although there is a method to remove the rust using an abrasive solid composed an abrasive material with such as a resinous material, it causes big frictional force to remove the rust, and in case described above it is more likely that the abrasive solid is damaged halfway. On the other hand as by decreasing a composition amount of the abrasive material so as to reduce the frictional force in abrasion, it would not be capable to remove the rust.

SUMMARY OF THE INVENTION

An object of the present invention is therefore to provide an abrasive solid that can be severed, trimmed or cut by a user into any desired shape. Further, this abrasive solid used alone has to enable both the roughing abrasion and the smoothing abrasion of a metal surface or the like, without needing two or more abrasive tools.

Herein "a tensile strength" test is carried out in accordance with the method provided in JIS Standard K6251, using the second model of dumb-bell shape as a form of a test piece, measuring at 23° C., at a tensile speed of 500 mm/min and being calculated from a maximum tension until the test piece ends to cut. Here JIS Standard K6251 corresponds to an international standard ISO 37.

"A tear strength" test is carried out in accordance with the method provided in JIS Standard K6252, using an angle shape without cut as a test piece, measuring at 23° C., at a transfer speed of a test piece holder of 500 mm/min and being calculated from a maximum tearing force until the test piece ends to cut. Here JIS Standard K6252 corresponds to international standards ISO 34-1 and ISO 34-2.

Not so far as annotation in particular, referring to the present details, "a cutting resistance" is expressed to explain a maximum load applied to a cutter blade having a length of 22 mm or more and cutting a specimen 20 mm wide vertically into two at a speed of 7 mm/min. Further a maximum load is from starting to end of cutting.

"A hardness" is expressed to explain a resistance to dent, in other words quality or condition of being hard. Further not so far as annotation in particular, a hardness referring to the present details is measured by using type-A durometer provided in JIS Standard K6253. Here JIS Standard K6253 corresponds to international standards ISO 48 and ISO 7619.

"An abrasion loss in volume" is an index of an abrasion resistance and is expressed to explain an amount of loss in volume of a test piece by abrasion test. A measuring is carried out in accordance with the test method provided in JIS Standard K6264, being B method of constant-load Williams abrasion test, in 6 minutes of test time and a measurement is the value calculating abrasion loss amount per 1000 turns at a test temperature of 23° C. Here JIS Standard K6264 corresponds to an international standard ISO 4649.

Values for physical properties of the abrasive solid of the present invention specified in the present specification are measured under the conditions that materials for the abrasive solid have a specific shape provided in a test method of each value. Accordingly it is able to use a specific shape changed after making an abrasive solid, or it is also able to use a specific shape made from the same material as the one for an abrasive solid.

The abrasive solid of the invention is composed of a matrix or substrate (hereinafter the term "matrix" includes "substrate") and an abrasive material dispersed therein to form a solid mass, wherein the matrix is an organic high polymer material. It is preferable that the abrasive solid has a tensile strength of about 0.6–1.3 MPa and a tear strength of about 6–10 N/mm, both at the ambient temperature of 23° C.

The abrasive solid is hard to be damaged halfway in using even though a frictional force increases for abrasion and any cutter, knife or the like may conveniently be used to sever the solid into any shapes, if it has the tensile and tear strengths falling within the respective ranges noted above.

A further examination by the inventors reveals that a tear strength has a big influence on an abrasive solid to be damaged halfway in using and that it is remarkably hard to be damaged halfway in using an abrasive solid having the tensile and tear strengths falling within the respective ranges noted above.

Also preferably, the abrasive solid of the invention may have a cutting resistance of about 19.6–147 N (2–15 kgf). This value is a maximum load applied to a cutter blade, which load will be observed when the blade cuts into two a strip of said abrasive solid having a width of 20 mm wide. In this test, the cutter blade having a length of 22 mm or more will be driven at a speed of 7 mm per minute vertically to the surface of said strip.

A cutter, a knife or any other hand tool can be used to sever a piece of any desired shape from a larger mass, or trim the piece once severd, provided that the maximum load as the cutting resistance is included in the range noted above.

From another aspect, an abrasive solid provided herein comprises at least two sections each being composed of a matrix and an abrasive material dispersed therein to form a solid mass, the matrix being an organic high polymer material. The at least two sections are different from each other in particle size and/or kind of the abrasive materials.

Such an abrasive solid as consisting of the at least two sections different in nature of the abrasive materials is advantageous in that one and single derusting tool suffices to perform both the roughing abrasion and the smoothing abrasion of a metal surface or the like.

Desirably, the abrasive solid is of a hardness of 60 or more. Experiments made by the present inventors have revealed that such an abrasive solid would show a satisfactory derusting performance.

Abrasion loss in volume is preferably from about 2–4.5 cubic cm per 1000 turns.

From still another aspect, an abrasive solid provided herein comprises at least two sections adhered one to another and each composed of a matrix and an abrasive material dispersed therein to form a solid mass, the matrix being an organic high polymer material. The at least two sections are different from each other in particle size and/or kind of the abrasive materials.

Such an abrasive solid as consisting of the at least two sections adhered one to another and different in nature of the abrasive materials is advantageous in that one and single derusting tool suffices to perform both the roughing abrasion and the smoothing abrasion of a metal surface or the like.

The organic high polymer material may preferably be an elastomer such as a natural rubber or a synthetic one. These rubbers as the organic high polymer material will improve the abrasion solid in its derusting effect.

Preferable content of the abrasive material is about 30% by weight or more of the abrasive solid, and a more preferable content is 50% by weight or more.

The abrasive solids each containing the abrasive material at 30% by weight or more have proved excellent in their derusting effect.

The abrasive solids each having the matrix that is the natural and/or synthetic rubbers and each containing the abrasive material at 30% by weight or more have proved more excellent in their derusting effect.

One of the sections contains one abrasive material whose particles have passed a screen having a given number of meshes, whereas the other section contains the other abrasive material consisting of particles that have passed another screen whose number of meshes is greater by 30% than that of the material in said one section.

Such a distinctive difference in particle size between the sections is advantageous in that one and single derusting tool suffices well to effectively perform both the roughing abrasion and the smoothing abrasion of a metal surface or the like.

DESCRIPTION OF THE PREFERRED EMBODIMENTS

Figure 1:
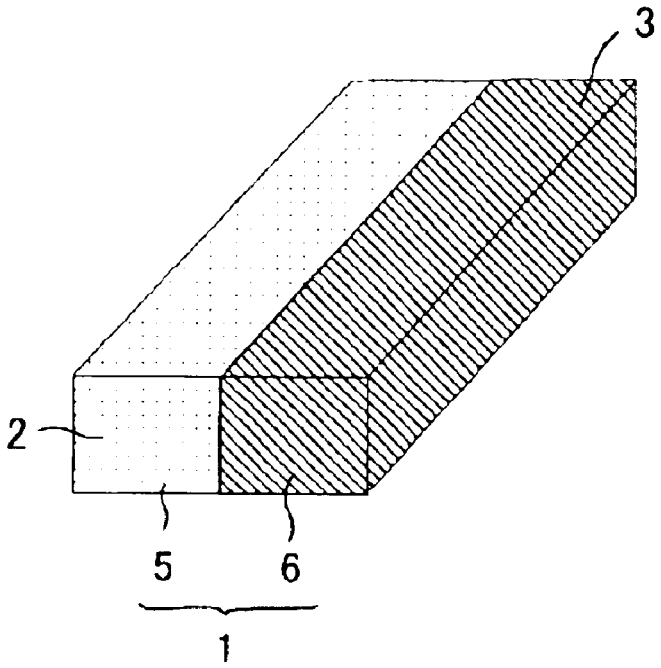
FIG. 1 is a perspective view of a deruster provided in a first embodiment of the present invention.

An abrasive solid 1 of the invention will be used to remove the rust from any objective article. Organic high polymer materials contained in the abrasive solid are matrices in which two types of abrasive materials 2,3 are dispersed, respectively. This abrasive solid 1 is a mass of a rectangular parallelepiped shape and divided into two sections 5 and 6, that adjoin one to another at an intermediate plane intersecting the medians of shorter sides of the parallelopipedon. Thus, each section 5 and 6 of the abrasive solid 1 in this embodiment is of a square-columnar shape. Those abrasive materials 2 and 3 contained in such sections are different from each other not only in particle size but also in chemical composition.

Each of the sections 5 and 6 in abrasive solid 1 of the present embodiment has a tensile strength of about 0.6–1.3 MPa and a tear strength of about 6–10 N/mm, both at the ambient temperature of 23° C.

Each section 5 and 6 of the abrasive solid 1 shows a cutting resistance of 19.6–147 N (2–15 kgf). This value was determined by measuring a maximum load applied to a cutter blade cutting into two a specimen 20 mm wide of each section. The blade having a length of 22 mm or more and was driven downwards at a speed of 7 mm per minute vertically to the surface of said specimen.

Tensile strength exceeding 1.3 MPa makes it difficult to smoothly use a cutter or knife in order to process the solid into a desired shape. Tear strength exceeding 10 N/mm does also affect adversely the processing of said solid.

Cutting resistance exceeding 147 N likewise renders the abrasive solid less easy to cut, sever or trim into a desired shape.

However, tensile strength below 0.6 MPa will cause fast abrasion of the solid 1, undesirably lowering its derusting effect. The abrasive solid's tear strength weaker than 6 N/mm will bring about a similar disadvantage.

The solid's cutting resistance lower than 19.6 N will result in its fast abrasion, also undesirably impairing its derusting performance.

In the present embodiment, each section 5 and 6 of the abrasive solid 1 preferably has a hardness of 60 or higher, and more preferably 70 or higher. Hardness lower than 60 renders the abrasive solid 1 too soft to effectively remove the rust from objective articles. As concerns hardness, there is no upper limit insofar as the cutting resistance falls within the range of 19.6–147 N.

The abrasive solid 1 shows an abrasion loss in volume ranging from 2 to 4.5 cubic cm per 1000 turns at the ambient temperature of 23° C. This means that said solid 1 is torn off at a moderate rate so that rust and the like are entrained in (viz., migrate into) the solid's surface so as to facilitate removal of rust from said articles. An excessive abrasion loss exceeding 4.5 cubic cm per 1000 turns will however give a poorer capability of removing rust. Likewise, an abrasion loss less than 2 cubic cm per 1000 turns causes insufficient migration and difficult removal of rust from the objective articles.

Abrasion loss included in the range of 2–4.5 cubic cm per 1000 turns avoids these disadvantages.

In the present invention, the organic high polymer as the matrix comprises resinous materials, rubbers and thermoplastic elastomers. The resinous material includes thermoplastic resins like polyvinyl chloride resins, thermosetting resins and the like. The rubbers include natural rubbers and synthetic ones. The polyvinyl chloride resins include polyvinyl chlorides, copolymers each composed of polyvinyl chloride and polyvinyl acetate, and the like. The thermoplastic elastomers employable herein are styrene-based ones, olefin-based ones, vinyl chloride-based ones, polyamide-based ones and the like. The thermosetting resins may be polyurethanes, polyphenols and the like.

The abrasive material may be particles or fibers of any metal, any intermetallic compound, any inorganic compound or the like. Either natural substances or synthetic substances can be employed as the abrasive material.

The natural abrasive materials employable herein are: powders of garnet, corundum, emery, diamond, spinel, quartz, rottenstone, silica, diatomaceous earth, pumice, granular pumice, feldspar, topaz, metal oxide minerals, whetstone, talc, bentonite, etc.

Aluminas, carbides, nitrides, borides and the like are examples of the synthetic abrasive materials.

Other substances serving as the abrasive material in the invention may include coarse particles or pulverized particles of any hard plastics, provided that they are harder than the matrix organic high polymer. In a case wherein any thermosetting resins are used as the abrasive material, they must have a melting point higher than the temperature at which the matrix organic high polymer is processed.

As to particle size of such an abrasive material, it must be such as collected through any one of appropriate screens ranging from a 10-mesh screen at coarsest to a 200-mesh screen at finest, both defined in the ISO standards. A more preferable screen is that which qualifies as a 20-mesh to 150-mesh screens.

Openings constituting the 10-mesh and 200-mesh screens are of sizes from 1.7 mm and 75 microns, respectively.

Openings constituting the 18-mesh and 150-mesh screens are of sizes from 1.0 mm and 100 microns, respectively.

Examples of the abrasive material preferably used herein are: carborundum, sintered alumina, glass powders, silica sand, quartz sand, Japanese volcanic ash called 'shirasu', emery, iron powder, copper powder and the like granular substances, glass fibers, metal fibers and the like. More preferable abrasive materials are glass powders and eme ry.

Content of the abrasive material in the abrasive solid may preferably be 30% by weight thereof or more, and more preferably 50% by weight or more.

A content poorer than 30% by weight is not sufficient for the abrasive material to ensure a satisfactory abrasion effect, though it may be useful to remove stain from the article.

As mentioned above, the discrete sections 5 and 6 forming the abrasion solid 1 of the present embodiment are different from each other in particle size and kinds of the abrasion materials 2 and 3. In order that one and single derusting tool 1 suffices well to perform both the roughing abrasion and the smoothing abrasion for a metal surface or the like, those abrasion materials 2 and 3 should be largely different in their particle sizes from each other.

In more detail, supposing that one of the sections 5 contains one abrasive material whose particles have passed a screen having a given number of meshes, the other section 6 has to contain the other abrasive material consisting of particles that have passed another screen whose number of meshes is greater by about 30% than that of the material in said one section 5.

More preferably, such a difference in the number of meshes for screening the abrasive materials may be designed to be 50% or more, based on the number of meshes in the coarser screen.

Any proper fillers may be blended with the materials forming the abrasion solid 1, and examples of such fillers are calcium carbonate, magnesium carbonate, talc, silica, alumina silicate and factice.

Further, any proper softeners and/or plasticizers may also be added, if necessary, to the abrasion solid. Examples of the softeners are mineral oils, vegetable oils, animal oils and silicone oils. The plasticizers usable herein are: dibutyl phthalate (DBP), diheptyl phthalate (DHP), dioctyl phthalate (DOP), diisononyl phthalate (DINP), diisodecyl phthalate (DIDP), diisooctyl adipate (DOA), diisononyl adipate (DINA), diisodecyl adipate (DIDA), dioctyl azelate (DOZ) and dioctyl sebacate (DOS).

It is preferable to blend a proper amount of sulfur and/or vulcanization accelerator with a rubber, if the latter is used as the matrix.

Any colorants and/or perfumes known in the art may also be added to the solid composition. Colorants of different hues will make it easy to visually distinct one section from the other, because abrasion materials of different particle sizes are preferably contained in the respective sections adhered or likewise adjoined to each other.

In one of feasible methods of constructing the abrasion solid 1 consisting of two sections 5 and 6, interim products thereof may be prepared at first to be consolidated later. Alternatively in the other method, both the sections may be formed simultaneously in a one-shot manner.

The former method will now be detailed below.

A proper amount of a selected matrix material, for example a rubber or an organic high polymer such as a polyvinyl chloride, will be intermixed and kneaded at first with another amount of an abrasive material (while being heated, if necessary). This mixture will then be pressed using any conventional press, extruded, injected or otherwise processed to give interim plates, sheets or strips.

In a case wherein a rubber is used as the matrix, it will be kneaded together with the abrasive material in an open roll, a kneader, a compression kneader, a Banbury mixer or the like. A mass thus kneaded will be rolled using a calender roll or the like to give 'first' interim products that may be plates or sheets. They will subsequently be slit into lengths of a strip, if so demanded. Unvulcanized rubber plates or sheets blended with the abrasion material blended therewith are prepared in this way as the first interim products.

A similar process will be conducted on the other hand so as to prepare 'second' interim products whose matrix is likewise an unvulcanized rubber but blended with another abrasion material (different from that in the first-mentioned interim products in particle size and/or in type or chemical composition).

One of those first and second interim products will be put on the other so that they are pressed and their rubber matrices are vulcanized to become integral with each other.

Figure 8:
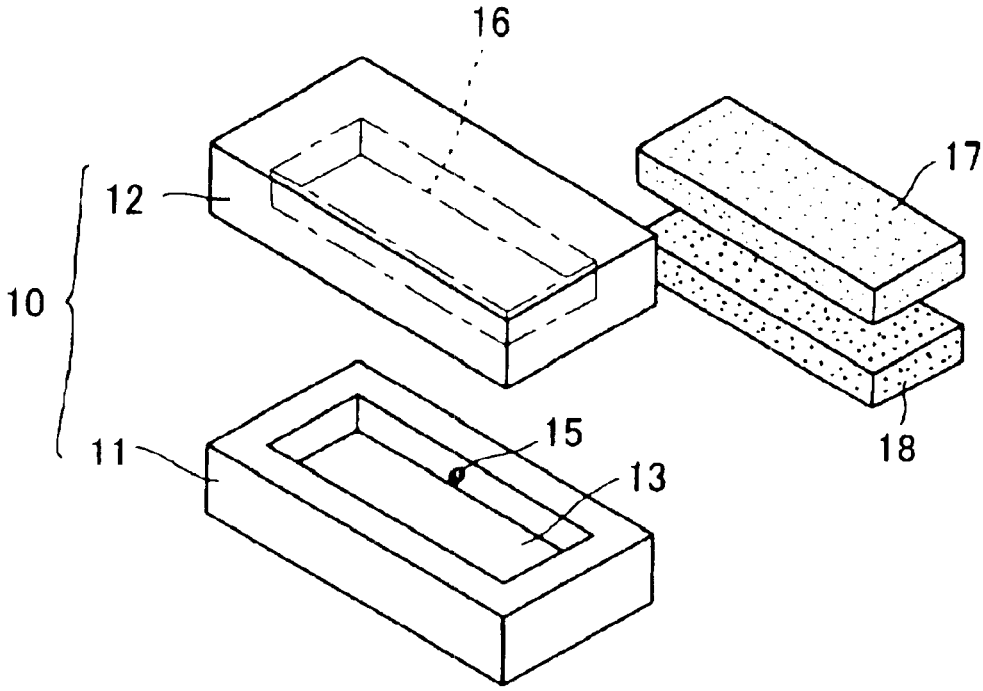
FIG. 8 is a perspective view of a mold and unvulcanized rubber sheets, illustrating the process of making an abrasive solid.

Those unvulcanized interim products laid one on the other may be interposed directly between flat panels of a press. It is however preferable that a mold 10 of a properly designed configuration is used to conduct the vulcanization pressing. As shown in FIG. 8, the mold 10 may comprise a lower segment 11 and an upper segment 12.

The lower segment 11 has in its central region a molding recess 13, and a temperature sensor 15 is disposed in this recess.

Similarly, the upper segment 12 also has a central molding recess 16.

In the present embodiment, two unvulcanized rubber plates 17 and 18 laid one on the other will be placed in the molding recess 13 of the lower segment 11. One of the unvulcanized rubber plates 17 contains not less than 50% by weight of one abrasion material, with the other plate 18 also containing not less than 50% by weight of another abrasion material differing from the former one in particle size and chemical kinds. The total thickness of the doubled plates 17 and 18 is designed to be moderately greater than the total depth of the mating recesses 13 and 16.

The doubled unvulcanized plates 17 and 18 will be put in the recess 13 of the lower mold segment 11, which is subsequently closed with the upper one 12 before a pressing mechanism not shown will press those plates together while heating the mold 10. The heating of the mold may either be effected using steam, or by a high-frequency heating system.

Due to a pressure which the pressing machine applies to the plates 17 and 18, they will be firmly adjoined to each other. The surplus of such unvulcanized rubber masses will swell out of the mating recesses 13 and 16 through an interstice present between the mold segments 11 and 12, to thereby produce a flash.

The sensor 15 disposed in the lower segment 11 will detect the internal temperature thereof to control the vulcanization process. After a predetermined vulcanization time, the mold 10 will be opened to take out the rubber product.

The rubber product thus taken out of the mold is composed of two portions that are firmly united but are of different compositions. This rubber product will then be severed into a plurality of abrasion solids as shown in FIG. 1. However, the fresh product just pulled out from the mold 10 has outer layers that have been in close contact with the inner surfaces of said mold, merely exposing an insufficient number of abrasion material particles. Therefore, those surface layers must be cut off to expose a large number of the abrasion particles.

The calender roll noted above may also be used to produce thinner raw sheets or plates, which will then be piled up to be rolled together to give each section of the interim abrasion solid. This method is advantageous in that variation initially present in an unmolded rubber/abrasives composition will be diminished.

Any extrusion or injection molding method may alternatively be employed in place of such a calender rolling, for the same purpose of preparing those interim products of a desired configuration.

Consolidation of the preparatorily formed halves can not only be effected by the described rolling technique, but also by any other means such as adhesives or solvents. If any proper solvents are used, then the surfaces of organic high polymer materials as matrices will be dissolved in part to be bonded together.

Alternatively, those preparatory organic high polymer halves may merge into an integral piece at their portions engageable with each other, one fitting in the other.

As discussed above, the latter option is the simultaneous forming of the two sections. For this purpose, two pairs of rolls may be used to produce two rubber sheets of different compositions. These fresh rubber sheets will be laid one on another to be pressed immediately after discharge from respective pairs of rolls. A certain multi-color extruder may alternatively be used to form two resinous flows of different compositions and preferably of different colors, in unison with each other, so that they will adhere one to another upon exit from the extruder.

Each of the two sections 5 and 6 has been described above to have its own tensile strength, tear strength, hardness and abrasion loss in volume, all included in respective ranges. It may however suffice that only either of them has such specified properties in order to afford the described effects, reasonable but not best.

Although the abrasive solid shown in FIG. 1 consists of two sections 5 and 6, it may comprise more sections. For example, the abrasive solid 20 shown in FIG. 2 is composed of six parallelepiped sections 20*a*–20*f* that are arranged side by side and bonded to each other to make the solid plate-shaped as a whole.

Figure 2:
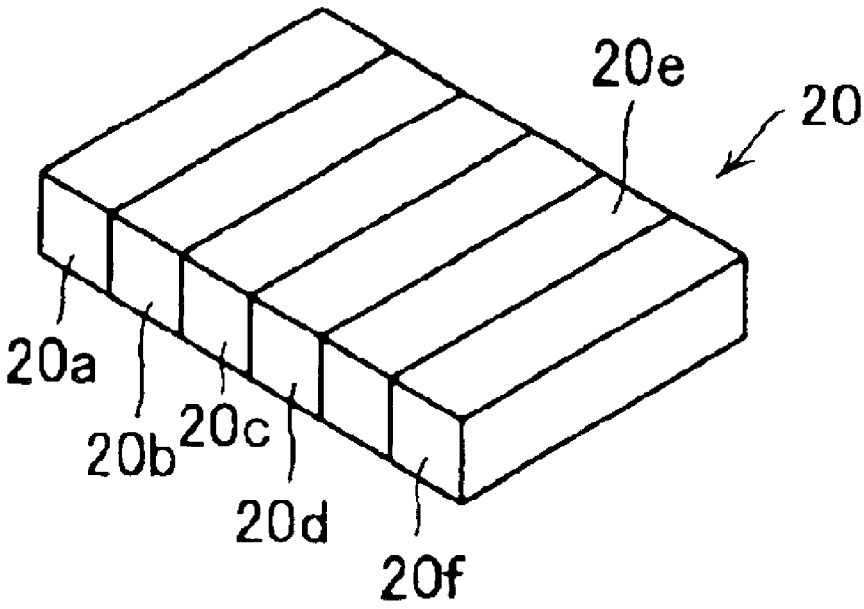
FIG. 2 is a perspective view of another deruster provided in a second embodiment.

The abrasive solid 20 of FIG. 2 will be manufactured by piling up six unvulcanized sheets in a common direction, then pressing them and finally slicing the resultant interim product in the same direction.

Figure 3:
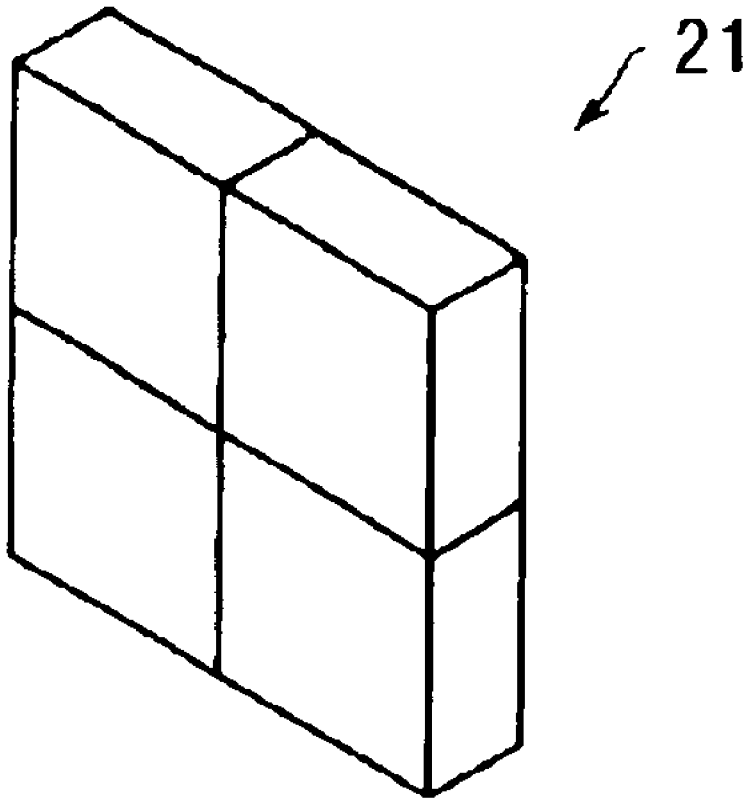
FIG. 3 is a perspective view of still another deruster provided in a third embodiment.
Figure 4:
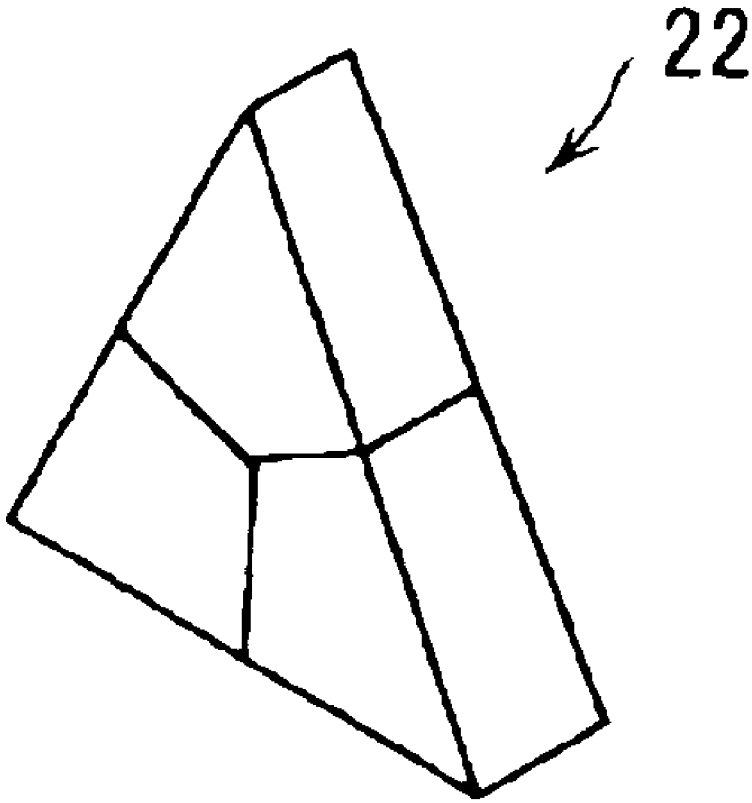
FIG. 4 is a perspective view of yet still another deruster provided in a fourth embodiment.

Although both the abrasive solid 1 and 20 shown in FIGS. 1 and 2 consist each of a parallel array of square-columnar sections, a further abrasive solid 21 may be divided into sections that are included in one and the same plane as shown in FIG. 3. This solid 21 looks like a square plate, in which a cruciform demarcation line divides it into four square sections. Instead, a pair of crossing diagonal lines can divide the abrasion solid into triangular sections. Because two adjacent sections undesirably merge into each corner, making it difficult to use, any plane abrasive solid may preferably be divided by lines lying in parallel with one or more sides. FIG. 4 shows a further abrasive solid 22 that is triangular in its entirety and divided by three demarcation lines into three sections. Each demarcation line intersects the middle point of one side, and the three lines merge into a central point of this solid 22.

Figure 5:
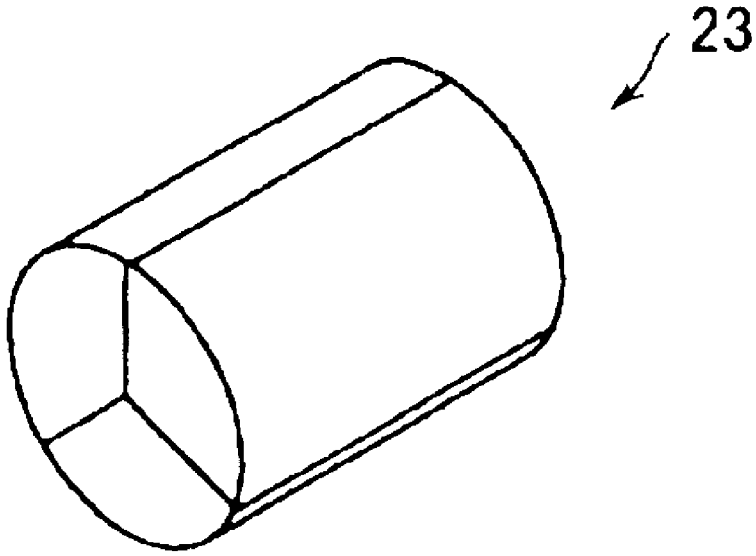
FIG. 5 is a perspective view of a further deruster provided in a fifth embodiment.
Figure 6:
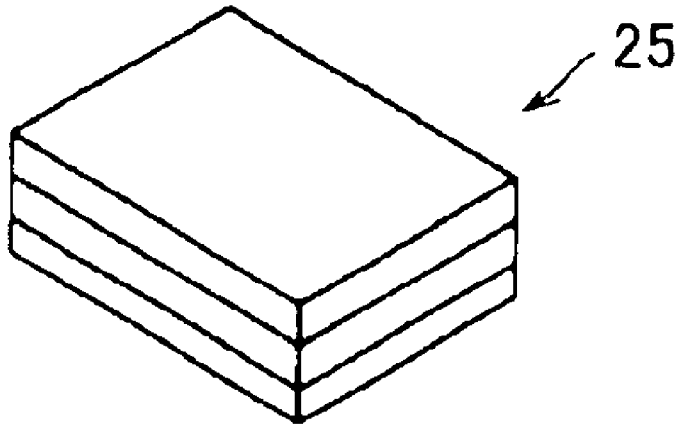
FIG. 6 is a perspective view of a still further deruster provided in a sixth embodiment.
Figure 7:
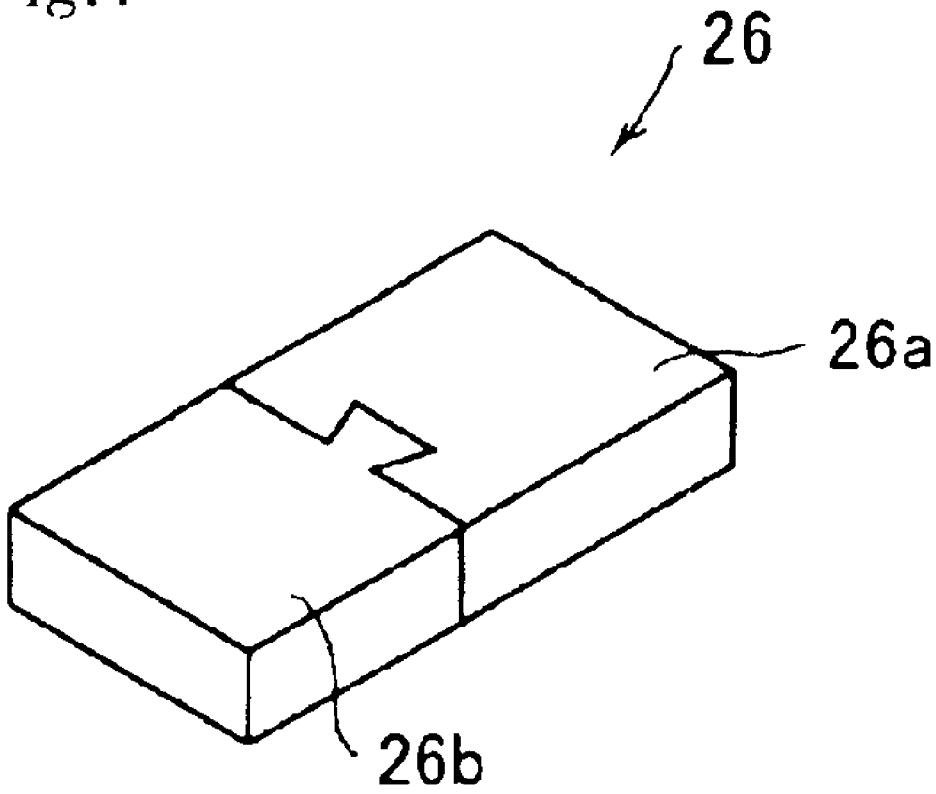
FIG. 7 is a perspective view of a yet still further deruster provided in a seventh embodiment.

FIGS. 5 to 7 illustrate further examples of the shape of abrasive solid of the invention. The solid 23 of FIG. 5 is generally of a columnar shape that is also divided into three sections by longitudinal demarcation planes.

Another abrasive solid 25 shown in FIG. 6 is generally a parallelepiped that is divided into three parallel sections by two planes extending perpendicular to the thickness of this solid.

Still another abrasive solid 26 of FIG. 7 is generally rectangular and divided into two sections 26*a* and 26*b* that have sides secured to each other by a dovetail joint. In detail, a mortise is formed in one of the adjoining sides so as to fit on a tenon formed in the other side.

The abrasive solids 1, 20, 21, 22, 23, 25 and 26 may be used in the following manner.

Prior to use of any one of the solids 1, 20, 21, 22, 23, 25 and 26, a hand tool such as a knife or cutter will be used at first to trim it into any desired shape in conformity with the portion of an objective article to be derusted.

Each of the abrasive solids 1, 20, 21, 22, 23, 25 and 26 has a tensile strength of 0.6–1.3 MPa, a tear strength of 6–10

N/mm and a cutting resistance of 19.6–147 N (2–15 kgf), all at the ambient temperature of 23° C. Therefore, it is easy for the knife or the like tool to change or adjust the shape of such an abrasion solid.

Each of the abrasive solids 1, 20, 21, 22, 23, 25 and 26 is divided into two or more sections that contain different abrasive materials, so that one and the same abrasive solid suffices well to perform both the roughing abrasion and the finishing abrasion of a metal surface or the like.

The effects afforded herein will become more apparent from the following description of some tests.

Exemplary compositions showed below are some of many examples, so that kinds and contents of such as the matrix noted above and fillers may be converted, so as to change tensile strength, tear strength, cutting resistance, hardness and abrasion loss in volume in a given value. Such method may be carried out by the conventional method.

For example, harder matrix or less softeners and/or plasticizers can make tensile strength stronger. Less softeners and/or plasticizers and harder matrix can make cutting resistance higher. Adding neither softeners nor plasticizers, adding less softeners and/or plasticizers, more abrasive materials, or harder matrix can make hardness higher.

Further by changing a condition of processing, materiality may be changed. For example, in case of rubber, higher vulcanization temperature, more vulcanization material can make harder, tensile strength stronger and tear strength stronger.

[EXEMPLARY COMPOSITIONS #1]

In Example-1, compositions 'A' and 'B' were prepared and kneaded respectively using a two-roll kneader to give two sheets, that were subsequently put one on another to be pressed for 30 minutes at 140° C. A cutter was then used to sever the resultant composite sheet into specimens, one of which is shown in FIG. 1.

Ingredients of Composition 'A'

| | |
|---|---|
| IR (isoprene rubber) | 3.5% |
| NR (natural rubber) | 3.5% |
| SBR (styrene-butadiene rubber) | 3.0% |
| petrolatum | 0.5% |
| glass powder (passing a 150-mesh screen) | 62.5% |
| factice | 20.0% |
| sulfur | 0.7% |
| zinc white | 0.6% |
| hydrated lime | 2.0% |
| vulcanization accelerator | 0.5% |
| titanium dioxide | 3.0% |
| phthalocyanine blue | 0.2% |

[Notes: All the contents in this table and the following tables are shown in '% by weight'.]

Ingredients of Composition 'B'

| | |
|---|---|
| IR (isoprene rubber) | 3.5% |
| NR (natural rubber) | 3.5% |
| SBR (styrene-butadiene rubber) | 3.0% |
| petrolatum | 0.5% |
| glass powder (passing a 70-mesh screen) | 62.5% |
| factice | 20.0% |
| sulfur | 0.7% |
| zinc white | 0.6% |
| hydrated lime | 2.0% |
| vulcanization accelerator | 0.5% |
| titanium dioxide | 2.0% |
| diallylide yellow | 1.2% |

The glass powder passing the 150-mesh screen in the table is a glass-based abrasive, and this screen meeting one of the ISO standard requirements has openings whose size is about 100 microns.

The further glass powder passing the 70-mesh screen in the table is another glass-based abrasive, and this screen meeting the other ISO standard requirements has openings whose size is about 212 microns.

Difference between these screens in their numbers of openings is about 114%, and difference between them in their opening sizes is about 112%.

An abrasive solid formed of EXEMPLARY COMPOSITIONS #1 had an A-side section whose tensile strength and tear strength were 1.08 MPa and 7.9 N/mm, respectively.

An abrasion test of this A-side section showed abrasion loss in volume of 3.17 $cm^3$ per 1000 turns.

The abrasive solid formed of EXEMPLARY COMPOSITIONS #1 had a B-side section whose tensile strength and tear strength were 0.83 MPa and 7.8 N/mm, respectively.

An abrasion test of this B-side section showed abrasion loss in volume of 3.72 $cm^3$ per 1000 turns.

Figure 11:
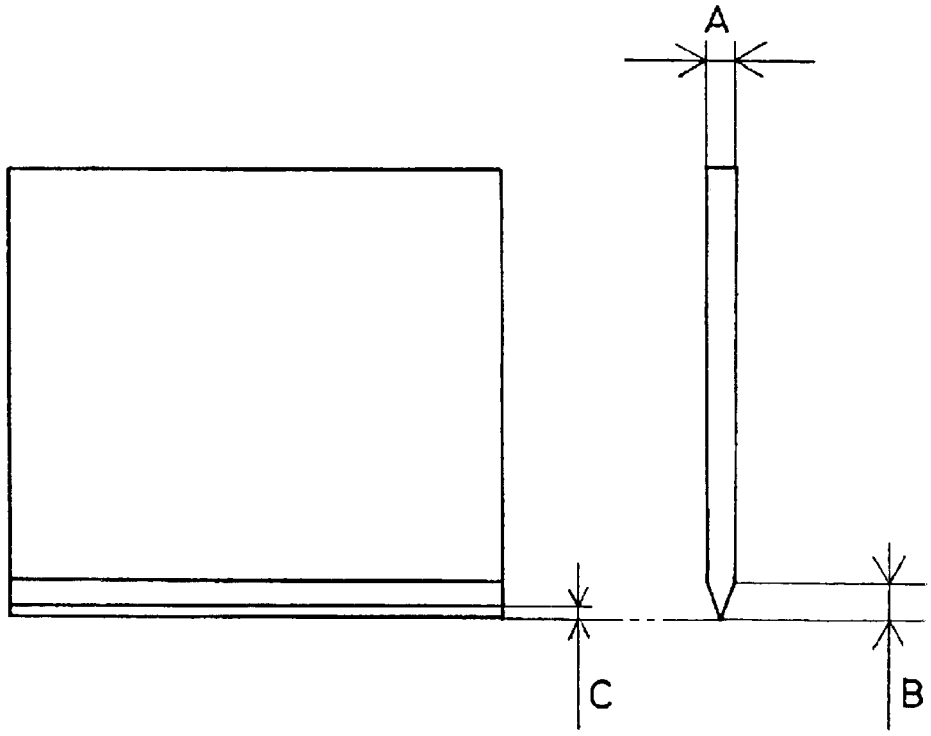
FIG. 11 is a front view and a side view showing a cutter shape used for cutting resistance.

Test of the cutting resistance of this abrasive solid was carried out using the apparatuses 'TEST STAND MODEL 1307' and 'CPU GAUGE 9550', both of the AIKOH ENGINEERING CORP., and gave the value of 58.8 N. Hardness of the said solid was 84. Further "a cutter" used for the test is made of carbon tool steel. Its shape is shown as FIG. 11, detailed with width A of the cutter being about 0.82 mm, length B of a point of the cutter being about 3.7 mm and length C of an abrasive part of the point being about 0.23 mm. Using a cutter 'brand number LARGE CUTTER LB10K' of the ORFA Co., Ltd. to evaluate a cuttability in the same way, it revealed the same cuttability.

[EXEMPLARY COMPOSITIONS #2]

In Example-2, compositions 'A' and 'B' were prepared and kneaded respectively using a two-roll kneader to give two sheets, that were subsequently put one on another to be pressed for 30 minutes at 140° C. A cutter was then used to sever the resultant composite sheet into specimens, one of which is shown in FIG. 1.

Ingredients of Composition 'A'

| | |
|---|---|
| IR (isoprene rubber) | 8.0% |
| SBR (styrene-butadiene rubber) | 4.0% |
| glass powder (passing a 150-mesh screen) | 60.0% |
| factice | 20.0% |
| sulfur | 1.0% |
| vulcanization accelerator | 3.0% |
| titanium dioxide | 3.0% |
| phthalocyanine blue | 1.0% |

Ingredients of Composition 'B'

| | |
|---|---|
| IR (isoprene rubber) | 8.0% |
| SBR (styrene-butadiene rubber) | 4.0% |
| glass powder (passing a 80-mesh screen) | 60.0% |

-continued

| | |
|---|---|
| factice | 20.0% |
| sulfur | 1.0% |
| vulcanization accelerator | 3.0% |
| titanium dioxide | 2.0% |
| naphthol red | 2.0% |

The glass powder passing the 150-mesh screen in the table is a glass-based abrasive, and this screen meeting one of the ISO standard requirements has openings whose size is about 100 microns.

The further glass powder passing the 80-mesh screen in the table is another glass-based abrasive, and this screen meeting the other ISO standard requirements has openings whose size is about 180 microns.

Difference between these screens in their numbers of openings is about 88%, and difference between them in their opening sizes is about 80%.

An abrasive solid formed of EXEMPLARY COMPOSITIONS #2 had an A-side section whose tensile strength and tear strength were 1.27 MPa and 9.4 N/mm, respectively.

Abrasion test of this A-side section showed 2.07 $cm^3$ per 1000 turns.

The abrasive solid formed of EXEMPLARY COMPOSITIONS #2 had a B-side section whose tensile strength and tear strength were 1.15 MPa and 9.2 N/mm, respectively.

Abrasion test of this B-side section showed 2.51 $cm^3$ per 1000 turns.

Test of the cutting resistance of this abrasive solid gave the value of 50.1 N. Hardness of the said solid was 80.

[EXEMPLARY COMPOSITIONS #3]

In Example-3, compositions 'A' and 'B' were kneaded respectively using a kneader to give two discrete lots of pellets. Each lot of these pellets was molten in and extruded from a two-color extruder at 100° C., so as to provide a striped interim product. A cutter was then used to sever this product into specimens, one of which is shown in FIG. 1.

Ingredients of Composition 'A'

| | |
|---|---|
| SBS (styrene-butadiene styrene copolymer) | 10.0% |
| liquid paraffin | 3.0% |
| emery (passing a 150-mesh screen) | 70.0% |
| calcium carbonate | 14.0% |
| titanium dioxide | 2.5% |
| phthalocyanine green | 0.5% |

Ingredients of Composition 'B'

| | |
|---|---|
| SBS (styrene-butadiene styrene copolymer) | 10.0% |
| liquid paraffin | 3.0% |
| emery (passing a 100-mesh screen) | 70.0% |
| calcium carbonate | 14.0% |
| titanium dioxide | 2.0% |
| diallylide yellow | 1.0% |

The emery passing the 150-mesh screen in the table is an alumina-based abrasive, and this screen meeting one of the ISO standard requirements has openings whose size is about 100 microns.

The further emery passing the 100-mesh screen in the table is another diamond-based abrasive, and this screen meeting the other ISO standard requirements has openings whose size is about 150 microns.

Difference between these screens in their numbers of openings is about 50%, and difference between them in their opening sizes is 50%.

An abrasive solid formed of EXEMPLARY COMPOSITIONS #3 had an A-side section whose tensile strength and tear strength were 0.66 MPa and 6.7 N/mm, respectively.

Abrasion test of this A-side section showed 4.01 $cm^3$ per 1000 turns.

The abrasive solid formed of EXEMPLARY COMPOSITIONS #3 had a B-side section whose tensile strength and tear strength were 0.62 MPa and 6.4 N/mm, respectively.

Abrasion test of this B-side section showed 4.43 $cm^3$ per 1000 turns.

Test of the cutting resistance of this abrasive solid gave the value of 42.1 N, and hardness of this solid was 80.

[REFERENCE COMPOSITIONS #1]

In Reference-1, compositions 'A' and 'B' were prepared and kneaded respectively using a two-roll kneader to give two sheets, that were subsequently put one on another to be pressed for 30 minutes at 140° C. A cutter was then used to sever the resultant composite sheet into specimens, one of which is shown in FIG. 1.

Ingredients of Composition 'A'

| | |
|---|---|
| IR (isoprene rubber) | 6.0% |
| SBR (styrene-butadiene rubber) | 4.0% |
| glass powder (passing a 150-mesh screen) | 60.0% |
| factice | 4.0% |
| sulfur | 11.0% |
| vulcanization accelerator | 12.0% |
| titanium dioxide | 2.0% |
| phthalocyanine blue | 1.0% |

Ingredients of Composition 'B'

| | |
|---|---|
| IR (isoprene rubber) | 6.0% |
| SBR (styrene-butadiene rubber) | 4.0% |
| glass powder (passing a 80-mesh screen) | 60.0% |
| factice | 4.0% |
| sulfur | 11.0% |
| vulcanization accelerator | 12.0% |
| titanium dioxide | 2.0% |
| naphthol red | 1.0% |

An abrasive solid formed of REFERENCE COMPOSITIONS #1 had an A-side section whose tensile strength and tear strength were 1.39 MPa and 10.8 N/mm, respectively.

Abrasion test of this A-side section showed 1.71 $cm^3$ per 1000 turns.

The abrasive solid formed of REFERENCE COMPOSITIONS #1 had a B-side section whose tensile strength and tear strength were 1.35 MPa and 10.3 N/mm, respectively.

Abrasion test of this B-side section showed 1.92 $cm^3$ per 1000 turns.

Test of the cutting resistance of this abrasive solid gave the value of 172.5 N. Hardness of the said solid was 60.

[REFERENCE COMPOSITIONS #2]

In Reference-2, compositions 'A' and 'B' were kneaded respectively using a kneader to give two discrete lots of pellets. Each lot of these pellets was molten in and extruded from a two-color extruder at 100° C., so as to provide a striped interim product. A cutter was then used to sever this product into specimens, one of which is shown in FIG. 1.

Ingredients of Composition 'A'

| | |
|---|---|
| SBS (styrene-butadiene styrene copolymer) | 12.0% |
| liquid paraffin | 12.0% |
| emery (passing a 150-mesh screen) | 60.0% |
| calcium carbonate | 13.0% |
| titanium dioxide | 2.5% |
| phthalocyanine green | 0.5% |

Ingredients of Composition 'B'

| | |
|---|---|
| SBS (styrene-butadiene styrene copolymer) | 12.0% |
| liquid paraffin | 12.0% |
| emery (passing a 100-mesh screen) | 60.0% |
| calcium carbonate | 13.0% |
| titanium dioxide | 2.0% |
| diallylide yellow | 1.0% |

An abrasive solid formed of REFERENCE COMPOSITIONS #2 had an A-side section whose tensile strength and tear strength were 0.56 MPa and 5.7 N/mm, respectively.

Abrasion test of this A-side section showed 4.87 $cm^3$ per 1000 turns.

The abrasive solid formed of REFERENCE COMPOSITIONS #2 had a B-side section whose tensile strength and tear strength were 0.52 MPa and 5.4 N/mm, respectively.

Abrasion test of this B-side section showed 5.31 $cm^3$ per 1000 turns.

Test of the cutting resistance of this abrasive solid gave the value of 13.7 N. Hardness of the said solid was 55.

Now, results of evaluation of the examples and references are listed in the following tables.

TABLE 1

TEST RESULTS ON CUTTABILITY

| Compositions | | Tensile Strength (MPa) | | Tear strength (N/mm) | Cutting resistance (N) | 'Cuttability' [A: good, B: medium, C: worse] |
|---|---|---|---|---|---|---|
| Example-1 | A-side | 1.08 | A-side | 7.9 | 58.8 | A |
| | B-side | 0.83 | B-side | 7.8 | | |
| Example-2 | A-side | 1.27 | A-side | 9.4 | 50.1 | A |
| | B-side | 1.15 | B-side | 9.2 | | |
| Example-3 | A-side | 0.66 | A-side | 6.7 | 42.1 | A |
| | B-side | 0.62 | B-side | 6.4 | | |
| Reference-1 | A-side | 1.39 | A-side | 10.8 | 172.5 | C |
| | B-side | 1.35 | B-side | 10.3 | | |
| Reference-2 | A-side | 0.56 | A-side | 5.7 | 13.7 | A |
| | B-side | 0.52 | B-side | 5.4 | | |

Notes:
'A-side' and 'B-side' denote the A-side section and B-side section of the abrasive solid, respectively.

The results listed above in Table 1 show that good cuttability will be ensured if the sections have a tensile strength of from 0.6–1.3 MPa and a tear strength of from 6–10 N/mm, both measured at the ambient temperature of 23° C.

It was further confirmed that if each specimen of the sections of abrasive solid shows a cutting resistance of 19.6–147 N (2–15 kgf), then a good cuttability would be ensured. This value was determined by measuring a maximum load applied to a cutter blade having a length of 22 mm or more and cutting into two a specimen 20 mm wide at a speed of 7 mm/min.

TABLE 2

TEST RESULTS ON RUST REMOVING EFFECT

| Compositions | Hardness | | Abrasion loss in volume ($cm^3$/100 turns) | 'Derusting' effect [A: good, B: medium, C: worse] |
|---|---|---|---|---|
| Example-1 | 84 | A-side | 3.17 | A-side: A |
| | | B-side | 3.72 | B-side: A |
| Example-2 | 80 | A-side | 2.07 | A-side: A |
| | | B-side | 2.51 | B-side: A |
| Example-3 | 80 | A-side | 4.01 | A-side: A |
| | | B-side | 4.43 | B-side: A |
| Reference-1 | 60 | A-side | 1.71 | A-side: B |
| | | B-side | 1.92 | B-side: B |
| Reference-2 | 55 | A-side | 4.87 | A-side: C |
| | | B-side | 5.31 | B-side: C |

The rust removing effect of each sample is listed in Table 2 above. This effect was determined herein by counting the number of manual abrasion strokes made along a length of rusted steel pipe until brown rust was rubbed off from the outer surface of said pipe length. The number of strokes of 1–3 thus rated the abrasive solids as 'A' (good), with said number of 3–6 rating them as 'B' (medium), and said number of 7 or more rating them as 'C' (worse).

As will be seen from the results noted above, the abrasive solids whose hardness was 60 or higher and whose volume loss was 2–4.5 $cm^3$ per 1000 turns did prove satisfactory in their effect of removing rust.

Damage condition whether abrasive solids of the examples and references are cracked or damaged in the middle in its using was examined. Thus results on effect are listed in the following tables. The detailed method of effect is as follows. After several manual abrasion strokes made along a length of rusted steel pipe until brown rust was rubbed off from the cutter surface of said pipe length, the condition in the middle of the abrasion solid was examined. Nothing wrong rated the abrasive solids as 'A' (good), with small crack rating them as 'B' (medium), and large crack or ending to cut rating them as 'C' (worse).

TABLE 3

TEST RESULTS ON DAMAGE CONDITIONS IN THEIR USING

| Compositions | | Tensile Strength (MPa) | | Tear strength (N/mm) | 'Damage condition' [A: good, B: medium, C: worse] |
|---|---|---|---|---|---|
| Example-1 | A-side | 1.08 | A-side | 7.9 | A |
| | B-side | 0.83 | B-side | 7.8 | |
| Example-2 | A-side | 1.27 | A-side | 9.4 | A |
| | B-side | 1.15 | B-side | 9.2 | |
| Example-3 | A-side | 0.66 | A-side | 6.7 | A |
| | B-side | 0.62 | B-side | 6.4 | |
| Reference-1 | A-side | 1.39 | A-side | 10.8 | A |
| | B-side | 1.35 | B-side | 10.3 | |
| Reference-2 | A-side | 0.56 | A-side | 5.7 | C |
| | B-side | 0.52 | B-side | 5.4 | |

The results listed above show that it is not cracked nor ended to cut in the middle of the abrasive solid, if the sections have a tear strength of from 6–10 N/mm.

Further with more kinds of the examples and references evaluating a cuttability and damage condition in detail, a relation between a tensile strength and a tear strength was examined. For additional examples and references, compositions and conditions of processing was used in converting as mentioned above.

Figure 9:
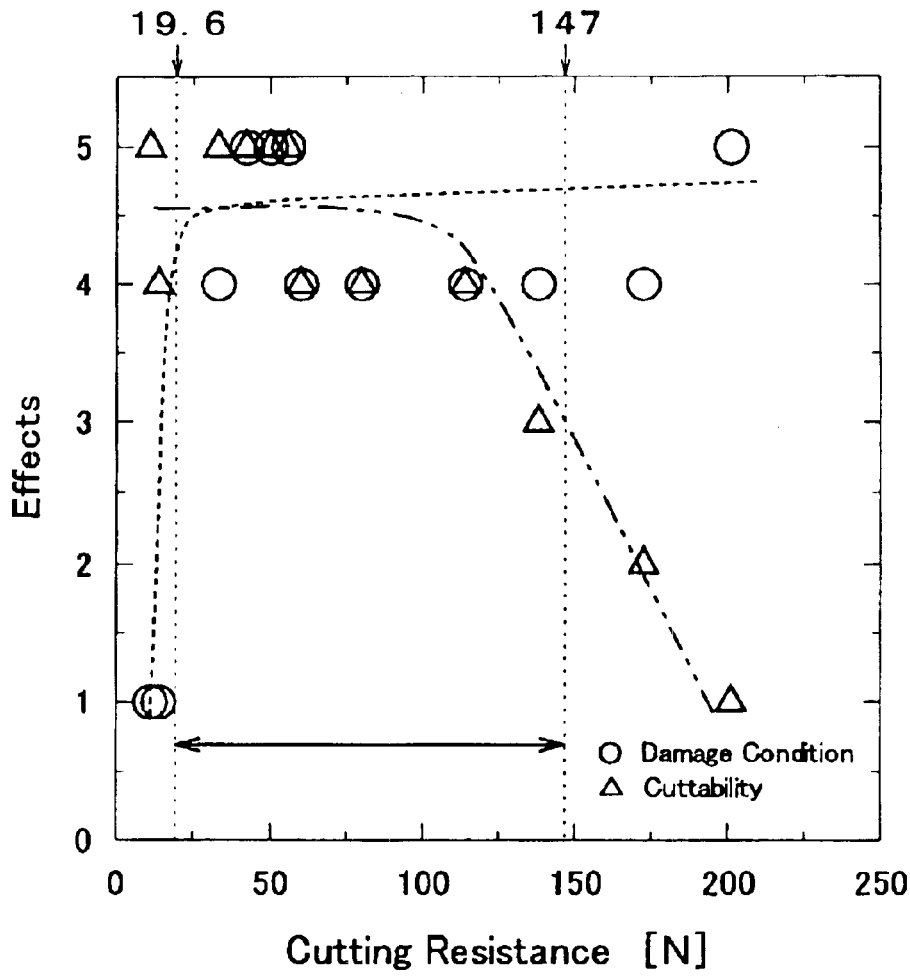
FIG. 9 is a graph showing the relation between a cutting resistance of an abrasive solid and a cuttability or a state of damage.
Figure 10:
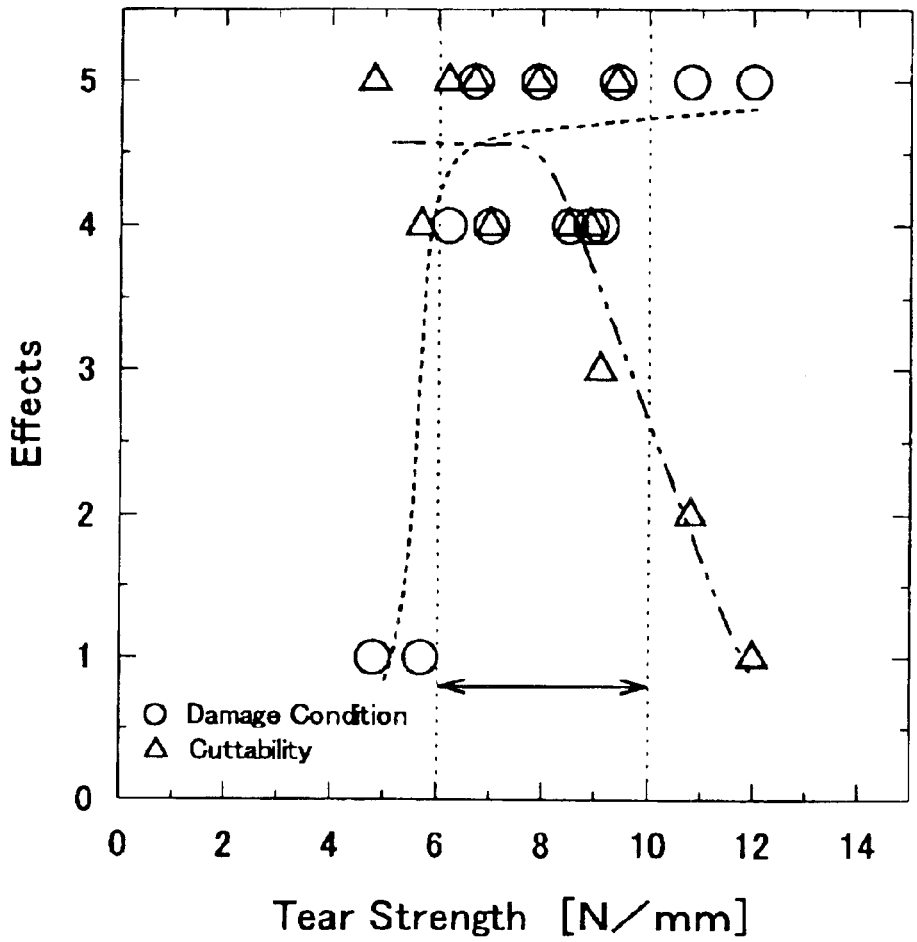
FIG. 10 is a graph showing the relation between a tear strength of an abrasive solid and a cuttability or a state of damage.

Thus the effects are listed in the FIGS. 9 and 10. The effect of a cuttability was determined by more detailed five stages than the effect mentioned above, $5^{th}$ stage being rated best and $1^{st}$ stage being rated worst. The effect of damage condition was determined by 5 stages as well. Such detailed test method is the same as the one mentioned above.

In result a tear strength within the range of 6–10 N/m gave good effect to a cuttability and damage condition. Further a cutting resistance within the range of 19.6–147 N (2–15 kgf) gave good effect to a cuttability and damage condition, particularly within the range of 39.2–117.6 N being better.

Further more to explain in detail, a tear strength not exceeding 6 N/m or a cutting resistance not exceeding 19.6 caused worse effect of damage condition, and also a tear strength of 10 N/m or more or a cutting resistance of 147 N or more caused worse effect of cuttability.

In summary, a fresh block of the abrasive solid comprising an abrasive material dispersed in an organic high polymer matrix preferably shows 19.6–147 N as its cutting resistance. Any knife or the like manual cutter may be used to easily sever and trim such an abrasive solid mass into any desired shape so that it can exhibit its inherent high capability of removing rust. The abrasive solid thus trimmed will match well the shape of any target article to rub rust off from its any narrow area. Further, two or more interim solids different in particle size of their abrasive materials are consolidated in a single composite mass, so that two or more types of discrete abrasives need no longer be prepared for performing rough and smooth abrasion works.

What is claimed is:

1. An abrasive solid composed of a) a matrix comprising i) a resinous material, ii) a rubber, or iii) a thermoplastic elastomer, and b) an abrasive material dispersed in the matrix to form a solid mass, wherein said abrasive solid has a tensile strength of 0.6–1.3 MPa and a tear strength of 6–10 N/mm at an ambient temperature of 23° C.

2. The abrasive solid as defined in claim 1, wherein said abrasive solid has a cutting resistance of 19.6–147 N (2–15 kgf), and said cutting resistance is determined by measuring a maximum load applied to a cutter blade having a blade length of 22 mm or more and being pressed down vertically to a specimen of the abrasive solid 20 mm wide at a speed of 7 mm/min so as to sever it into two.

3. The abrasive solid as defined in claim 1, wherein said abrasive solid has a hardness of 60 or higher.

4. The abrasive solid as defined in claim 1, wherein said abrasive solid has an abrasion resistance of an abrasion loss in volume of 2–4.5 $cm^3$ per 1000 turns.

5. The abrasive solid as defined in claim 1, wherein two or more sections differing from each other in particle size and/or kinds of the abrasive materials are consolidated in the solid.

6. The abrasive solid as defined in claim 1, wherein at least one ingredient of the matrix is a rubber.

7. The abrasive solid as defined in claim 1, wherein the abrasive material is present in an amount of at least 30% by weight.

8. The abrasive solid as defined in claim 1, wherein the abrasive material is present in an amount of at least 50% by weight.

9. An abrasive solid composed of a) matrices comprising i) a resinous material, ii) a rubber, or iii) a thermoplastic elastomer, and b) abrasive materials each dispersed in one of the matrices to form a solid mass, wherein two or more sections differing from each other in particle size and/or kinds of the abrasive materials are consolidated in the solid wherein at least one of the sections of said abrasive solid has a cutting resistance of 19.6–147 N (2–15 kgf), and said cutting resistance is determined by measuring a maximum load applied to a cutter blade having a blade length of 22 mm or more and being pressed down vertically to a specimen of each section 20 mm wide a speed of 7 mm/mm so as to sever it into two.

10. The abrasive solid as defined in claim 9, wherein at least one of the sections of said abrasive solid has a hardness of 60 or higher.

11. The abrasive solid as defined in claim 9, wherein at least one of the sections of said abrasive solid has an abrasion resistance of an abrasion loss in volume of 2–4.5 $cm^3$ per 1000 turns.

12. The abrasive solid as defined in claim 9, wherein at least one ingredient of the matrix in the at least one section is a rubber.

13. The abrasive solid as defined in claim 9, wherein the abrasive material is present in an amount of at least 30% by weight in at least one of the sections of said abrasive solid.

14. The abrasive solid as defined in claim 9, wherein the abrasive material contained in one of the sections is composed of particles having passed a first screen, and the abrasive material contained in the other section is composed of particles having passed a second screen that has openings more than those in the first screen by 30% or more.

15. An abrasive solid composed of a) a matrix comprising i) a resinous material, ii) a rubber, or iii) a thermoplastic elastomer, and b) an abrasive material dispersed therein to form a solid mass, wherein said abrasive solid has a cutting resistance of 19.6–147 N (2–15 kgf), and said cutting resistance is determined by measuring a maximum load applied to a cutter blade having a blade length of 22 mm or more and being pressed down vertically to a specimen of the abrasive solid 20 mm wide at a speed of 7 mm/mm so as to sever it into two.

16. The abrasive solid as defined in claim 15, wherein said abrasive solid has a hardness of 60 or higher.

17. An abrasive solid composed of a) a matrix comprising i) a resinous material, ii) a rubber, or iii) a thermoplastic elastomer, and b) an abrasive material dispersed therein to form a solid mass, wherein said abrasive solid has a tensile strength of 0.6–1.3 MPa and a tear strength of 6–10 N/mm at an ambient temperature of 23° C, said abrasive solid has a cutting resistance of 19.6–147 N (2–15 kgf), said cutting resistance is determine by measuring a maximum load applied to a cutter blade having a blade length of 22 mm or more and being pressed down vertically to a specimen of the abrasive solid 20 mm wide at a speed of 7 mm/min so as to sever it into two, said abrasive solid has a hardness of 60 or higher, said abrasive solid has an abrasion resistance of an abrasion loss in volume of 2–4.5 $cm^3$ per 1000 turns, two or more sections differing from each other in particle size and/or kinds of the abrasive materials are consolidated in the solid, and the abrasive material contained in one of the first and second sections is composed of particles having passed a first screen, and the abrasive material contained in the other of the first and second sections is composed of particles having passed a second screen that has openings more than those in the first screen by 30% or more.

* * * * *

UNITED STATES PATENT AND TRADEMARK OFFICE

CERTIFICATE OF CORRECTION

PATENT NO. : 6,929,669 B2
DATED : August 16, 2005
INVENTOR(S) : Nakao Tominaga et al.

It is certified that error appears in the above-identified patent and that said Letters Patent is hereby corrected as shown below:

Column 16,
Line 11, should read -- each section 20 mm wide at a speed of 7 mm/min so as to sever --.
Line 39, should read -- abrasive solid 20 mm wide at a speed of 7 mm/min --.

Signed and Sealed this

Twenty-eighth Day of March, 2006

JON W. DUDAS
*Director of the United States Patent and Trademark Office*